US007751762B2

(12) United States Patent
Hatayama et al.

(10) Patent No.: US 7,751,762 B2
(45) Date of Patent: Jul. 6, 2010

(54) TRANSFER DEVICE AND IMAGE FORMING APPARATUS INCLUDING THE SAME

(75) Inventors: Kohji Hatayama, Ikeda (JP); Tomofumi Inoue, Toyonaka (JP); Takeshi Sakashita, Ikeda (JP); Yuuji Meguro, Takarazuka (JP); Takeru Muramatsu, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 30 days.

(21) Appl. No.: 11/668,819

(22) Filed: Jan. 30, 2007

(65) Prior Publication Data

US 2007/0183816 A1 Aug. 9, 2007

(30) Foreign Application Priority Data

Jan. 30, 2006 (JP) ..... 2006-020988

(51) Int. Cl.
*G03G 15/01* (2006.01)
*G03G 15/16* (2006.01)

(52) U.S. Cl. ..... 399/299; 399/302

(58) Field of Classification Search ..... 399/302, 399/299, 298, 303, 313, 66, 308, 121
See application file for complete search history.

(56) References Cited

U.S. PATENT DOCUMENTS 6,470,166 B2 * 10/2002 Mizoguchi et al. ..... 399/302
2005/0074259 A1 * 4/2005 Tachiki et al. ..... 399/121
2007/0116496 A1 * 5/2007 Morimoto et al. ..... 399/299
2007/0116497 A1 * 5/2007 Yamazaki ..... 399/299
2008/0003022 A1 1/2008 Sakashita et al.

FOREIGN PATENT DOCUMENTS

JP 11-073035 A * 3/1999
JP 2002-258578 A * 9/2002
JP 2003-186313 7/2003
JP 2005-338437 A * 12/2005

OTHER PUBLICATIONS

U.S. Appl. No. 12/125,653, filed May 22, 2008, Inoue et al.

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

A transfer device including an intermediate transfer belt provided to extend in an arranged direction of a plurality of photosensitive drums, and primary transfer rollers each transferring a toner image formed on a corresponding one of the plurality of photosensitive drums to the intermediate transfer belt, each of the primary transfer rollers being moved between a position causing the intermediate transfer belt to be in contact with the photosensitive drums and a position causing the intermediate transfer belt to be separated from the photosensitive drums, each of the primary transfer rollers being rotatably supported by a movable member which includes an abutting portion which regulates a position of the primary transfer roller, the abutting portion abutting on an abutted member whose positional relationship with the photosensitive drum is defined such that the position of the abutted member causes the intermediate transfer belt to be in contact with the photosensitive drum.

28 Claims, 7 Drawing Sheets

TRANSFER DEVICE AND IMAGE FORMING APPARATUS INCLUDING THE SAME

CROSS-REFERENCE TO THE RELATED APPLICATION

This application is based on and claims the priority benefit of Japanese Patent Application No. 2006-020988 filed on Jan. 30, 2006, the disclosure of which is incorporated herein by reference in its entirety.

BACKGROUND OF THE INVENTION

1. Field of the Invention

The present invention relates to improvements in a transfer device including an intermediate transfer belt provided to extend in an arrangement direction of a plurality of photosensitive drums, and primary transfer rollers each transferring a toner image formed on a corresponding one of the photosensitive drums onto the intermediate transfer belt and an image forming apparatus including the transfer device.

2. Description of Related Art

Conventionally known is an image forming apparatus which has a structure including a transfer device provided with an intermediate transfer belt being driven in a state suspended in an arrangement direction of a plurality of photosensitive drums, and primary transfer rollers each transferring a toner image formed on a corresponding one of the photosensitive drums onto the intermediate transfer belt.

Each of the primary transfer rollers is moved away from and closer to the intermediate transfer belt between a position causing the intermediate transfer belt to be in contact with the photosensitive drums, and a position causing the intermediate transfer belt to be separated from the photosensitive drums (for reference, see Japanese Patent Application Publication No. 2003-186313).

Moreover, among the transfer devices, there is the one in which the center distance between the center axes of the photosensitive drum and the primary transfer roller at the position causing the intermediate transfer belt to be in contact with the photosensitive drums is set to be larger than the sum of the radiuses of the photosensitive drum of the primary transfer roller. The transfer device of this type is so-called an offset type transfer device.

In the meantime, a transfer device of this offset type has a configuration in which the position of the primary transfer rollers is changed between the position causing the intermediate transfer belt to be in contact with the photosensitive drums and the position causing the intermediate transfer belt to be separated from the photosensitive drums. Thus, a non-contacting distance of the intermediate transfer belt varies every time the position of the intermediate transfer belt is changed. Here, the non-contacting distance denotes a distance between a contacting portion at which the intermediate transfer belt is in contact with each of the photosensitive drums, and a contacting portion at which the intermediate transfer belt is in contact with a corresponding one of the primary transfer roller.

As a result, there is a problem that the power distribution resistance from the photosensitive drum to the primary transfer roller changes, and toner transfer efficiency varies.

SUMMARY OF THE INVENTION

An object of the present invention is to provide a transfer device which is capable of suppressing the variation in a non-contacting distance of an intermediate transfer belt, the variation occurring due to the reciprocating positional change of a primary transfer roller, and of suppressing the variation in toner transfer efficiency, and also to provide an image forming apparatus having a compact structure by use of the transfer device.

To accomplish the aforementioned object, a transfer device according to one embodiment of the present invention includes an intermediate transfer belt provided to extend in an arranged direction of a plurality of photosensitive drums, and primary transfer rollers each transferring a toner image formed on a corresponding one of the plurality of photosensitive drums to the intermediate transfer belt.

Each of the primary transfer rollers is moved between a position causing the intermediate transfer belt to be in contact with the photosensitive drums and a position causing the intermediate transfer belt to be separated from the photosensitive drums.

A center distance between a center axis of each of the photosensitive drums and a center axis of a corresponding one of the primary transfer rollers at the position causing the intermediate transfer belt to be in contact with the photosensitive drum is set to be larger than a sum of radiuses of the photosensitive drum and the primary transfer roller, the transfer device, and each of the primary transfer rollers being rotatably supported by a movable member.

The movable member includes an abutting portion which regulates a position of the primary transfer roller. The abutting portion abuts on an abutted member whose positional relationship with the photosensitive drum is defined such that the position of the abutted member causes the intermediate transfer belt to be in contact with the photosensitive drum.

The abutted member includes an abutted surface on which the abutting portion is abutted and which is configured to regulate at least one of positional deviations of the primary transfer rollers, the one positional deviation being a positional deviation in a direction perpendicular to a direction where the intermediate transfer belt is suspended.

DESCRIPTION OF THE PREFERRED EMBODIMENT

Hereinafter, preferred embodiments of the present invention will be explained in detail with reference to the accompanying drawings.

Figure 1:
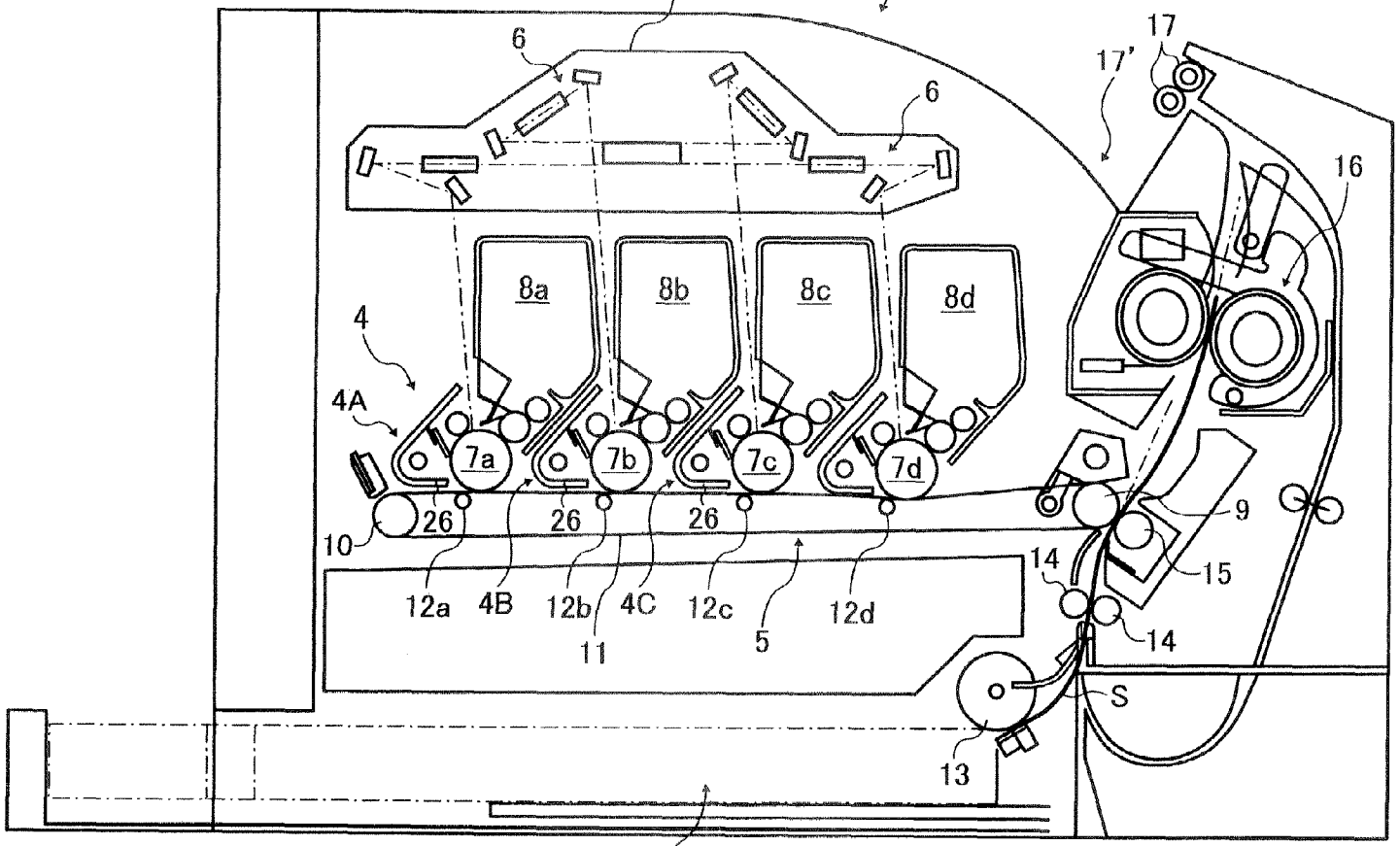
FIG. 1 is a diagram showing an overview of an image forming apparatus including a transfer device according the present invention.

FIG. 1 is an explanatory diagram showing an overview of the image forming apparatus including the transfer device according to the present invention. In FIG. 1, reference numeral 1 denotes a main body of the image forming apparatus of a tandem system. A paper feed tray 2 is provided at a bottom part of this main body of the image forming apparatus 1, and a light exposure device 3 is provided at an upper part of the main body of the image forming apparatus 1.

Photosensitive drum cases 4 are provided between the paper feed tray 2 and the light exposure device 3. A unit type transfer device 5 is provided below the photosensitive drum cases 4.

A stack of transfer sheets is set on the paper feed tray 2. The light exposure device 3 is provided with a light exposure optical system 6 which distributes illuminated light to each of the photosensitive drums. Descriptions of the light exposure optical system 6 will be provided later. It should be noted that a light source of the light exposure is omitted in FIG. 1.

Cylindrically-shaped photosensitive drums 7*a* to 7*d* are arranged in the photosensitive drum cases 4, respectively, in the order named at predetermined intervals of a predetermined distance. Here, the photosensitive drums 7*a*, 7*b*, 7*c* and 7*d* are for yellow, cyan, magenta and black, respectively. Process cartridges 8*a* to 8*d* of yellow, cyan, magenta and black colors are installed on the respective photosensitive drum cases 4, corresponding to the photosensitive drums 7*a* to 7*d*.

An electrostatic latent image is formed on each of the photosensitive drums 7*a* to 7*d* with the light exposed by the light exposure device 3. Then, a toner is provided from each of the process cartridges 8*a* to 8*d*, and then attached to each of the photosensitive drums 7*a* to 7*d*. Accordingly, a toner image (visual image) is formed on each of the photosensitive drums 7*a* to 7*d*.

A drive roller 9 and a tension roller 10 are provided to the transfer device 5 with an interval in the arrangement direction of the photosensitive drums 7*a* to 7*d*. An intermediate transfer belt 11 is provided so as to lie across on the drive roller 9 and the tension roller 10. The intermediate transfer belt 11 is rotated while being tightly suspended in the arrangement direction of the photosensitive drums 7*a* to 7*d*. Primary transfer rollers 12*a* to 12*d* are provided to the transfer device 5, corresponding to the respective photosensitive drums 7*a* to 7*d*. The primary transfer rollers 12*a* to 12*d* are in contract with the intermediate transfer belt 11. Descriptions of the configuration and the operations of these primary transfer rollers 12*a* to 12*d* will be provided later.

A paper feed roller 13 is provided at a lower part of the main body of the image forming apparatus 1 so as to face the paper feed tray 2. A transfer sheet S is pulled out from the paper feed tray 2 by the paper roller 13.

A pair of register rollers 14 are provided to the main body of the image forming apparatus 1 at a forward position in the direction of feeding the transfer sheet S. A secondary transfer roller 15 is provided at a forward position in the direction in which the transfer sheet S is fed by the pair of register rollers 14. The secondary transfer roller 15 faces the intermediate transfer belt 11 with the transfer sheet S sandwiched therebetween, An electrical potential difference is applied to the nip of each of the primary transfer rollers 12*a* to 12*d* and a corresponding one of the photosensitive drums 7*a* to 7*d*, and then a toner image formed on each of the photosensitive drums 7*a* to 7*d* is transferred onto the intermediate transfer belt 11 by the electrical potential difference and a pressurizing force applied by use of each of the primary transfer rollers 12*a* to 12*d*. The pair of register rollers 14 adjusts the front edge of the transfer sheet S and the front edge of the toner image to coincide with each other at the position of the secondary transfer roller 15.

Next, the toner image transferred onto the intermediate transfer belt 11 is transferred onto the transfer sheet S by using the secondary transfer roller 15.

A fixing device 16 is provided to the main body of the image forming apparatus 1 at a further forward position of the direction of feeding the transfer sheet S, onto which the toner image has been transferred. The toner attached onto the transfer sheet S is pressurized and fused, so that the toner image is fixed on the transfer sheet S as an image.

Subsequently, the transfer sheet S is delivered from the lower part of the main body of the image forming apparatus 1 to the upper part thereof by the paper feed roller 13, the pair of register rollers 14, the drive roller 9, the secondary transfer roller 15 and the fixing device 16. Then, the transfer sheet S is ejected to an ejection portion 17' of an upper part of the main body of the image forming apparatus 1 by a pair of ejection rollers 17.

Figure 2:
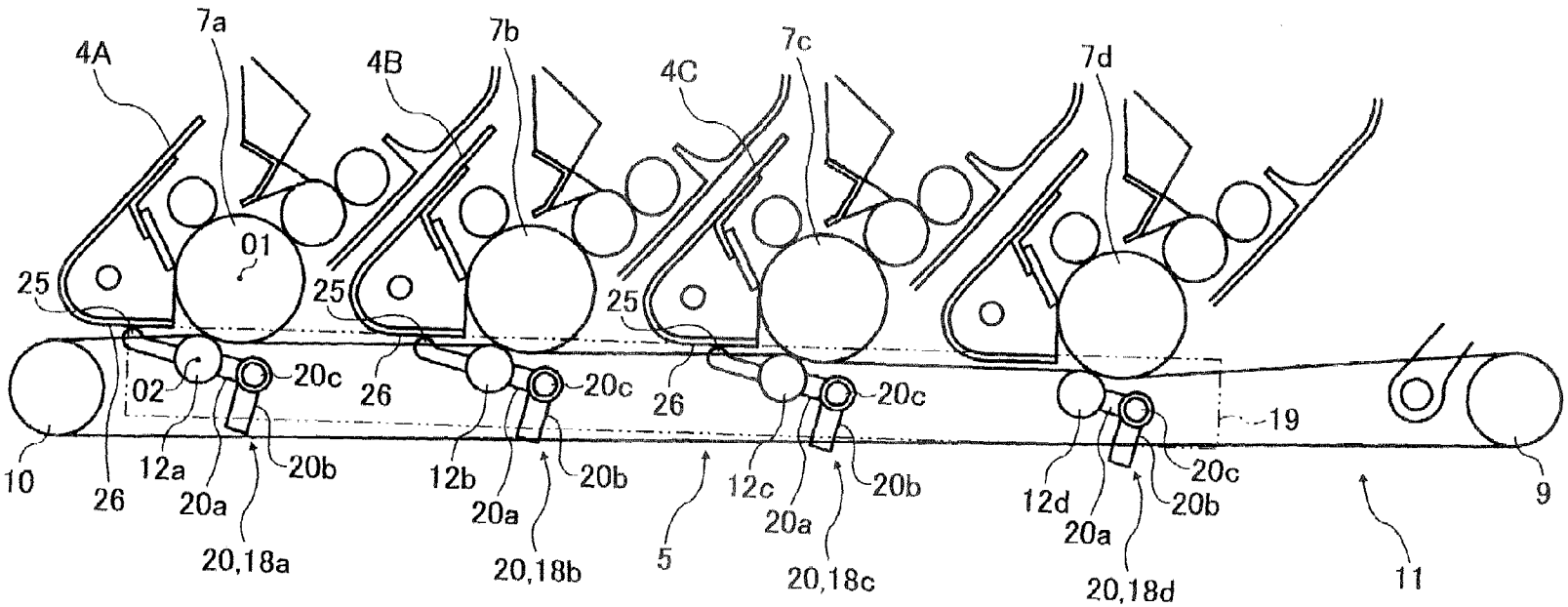
FIG. 2 is an explanatory diagram which shows the part of an intermediate transfer belt of the transfer device according to the present invention in an enlarged manner, and especially which shows a state where the intermediate transfer belt is in contact with photosensitive drums.

Movable members 18*a* to 18*d* are provided to the transfer device 5, corresponding to the respective photosensitive drums 7*a* to 7*d* as shown in an enlarged manner in FIG. 2. The movable members 18*a* to 18*d* are swingably supported by a fixing plate 19. Here, each of the movable members 18*a* to 18*d* is configured of a movable arm member 20. The movable arm member 20 is mainly configured of a support arm 20*a* and a drive arm 20*b*. The movable arm member 20 is rotatable around a rotation shaft 20*c*. The primary transfer rollers 12*a* to 12*d* are rotatably provided to the support arms 20*a*, respectively.

Figure 4:
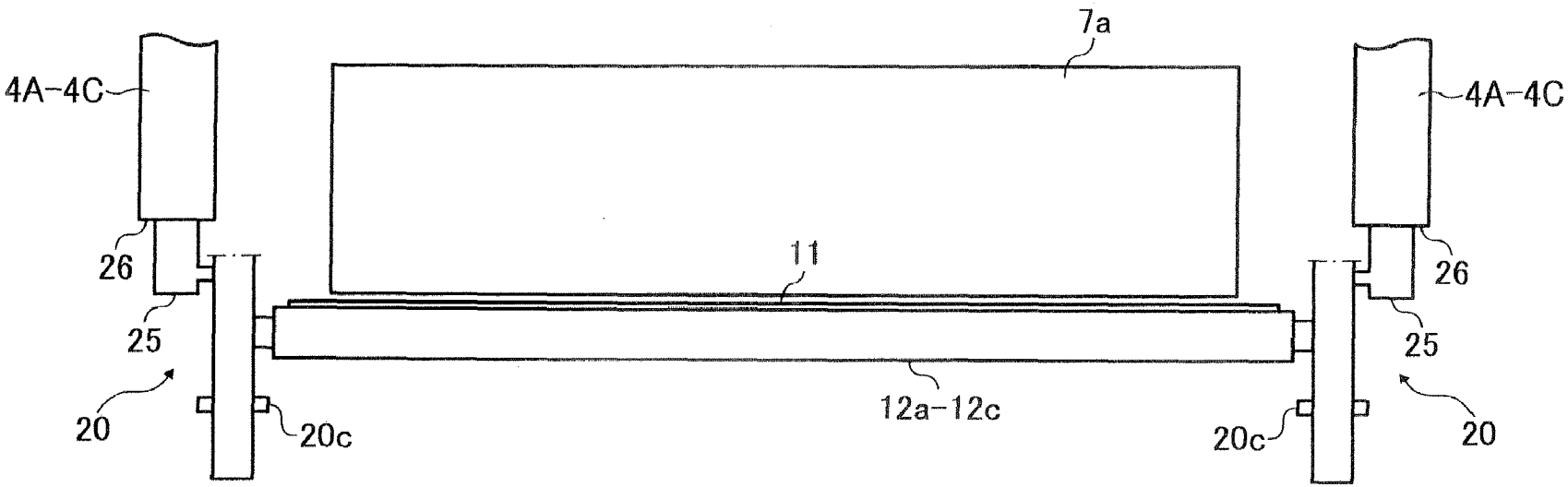
FIG. 4 is an explanatory diagram schematically showing relationships among primary transfer rollers, the photosensitive drums, and the intermediate transfer belt, according to the present invention.

The movable arm members 20 are provided as a pair with a distance interposed therebetween in the axial direction of the photosensitive drums 7*a* to 7*d* (the width direction of the intermediate transfer belt 11) as shown in FIG. 4. Each of the primary transfer rollers 12*a* to 12*d* is suspended on the pair of the movable members 20 as shown in FIG. 4.

Figure 5:
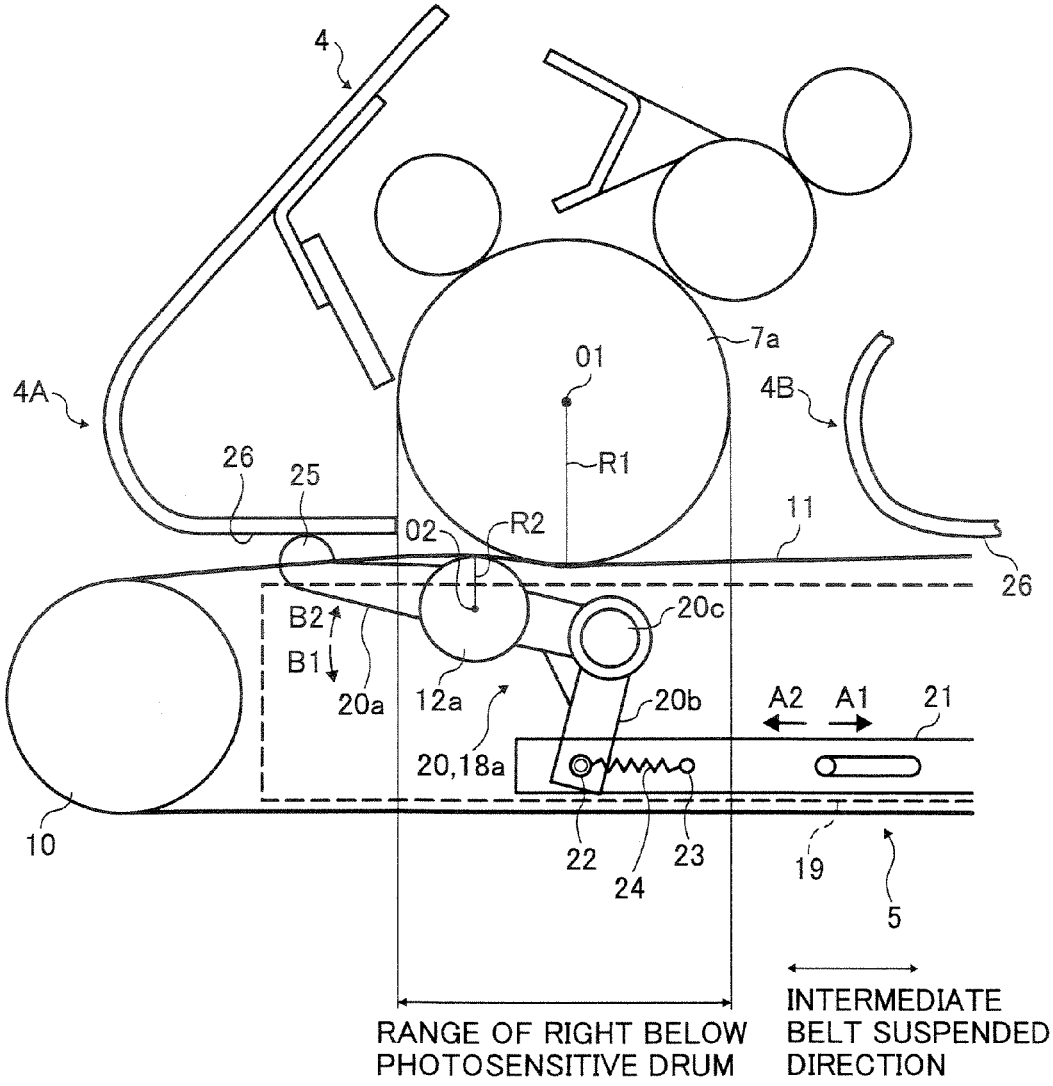
FIG. 5 is a partially enlarged diagram showing relationships among the primary transfer roller, an abutting portion, the photosensitive drum and an abutted surface, according to the present invention.

Here, the movable arm members 20 (18*a* to 18*c*) respectively for yellow, cyan and magenta colors are driven to rotate by a slide plate 21 as shown in FIG. 5, for example. FIG. 5 shows, as representatives, the photosensitive drum 7*a* and the pair of movable members 18*a* which corresponds to the photosensitive drum 7*a* in a partially enlarged manner.

The slide plate 21 is movable in a reciprocating manner in the directions in which the intermediate transfer belt 11 is tightly suspended (hereinafter, the directions are simply referred to as "the intermediate transfer belt 11 suspended directions"). A locking pin 22 is provided to each of the drive arms 20*b* of the movable arm members 20 (18*a* to 18*c*). Locking pins 23 each corresponding to each of the locking pins 22 are provided to the slide plate 21. A biasing spring 24 is provided between each of the locking pins 22 and a corresponding one of the locking pins 23.

The primary transfer rollers 12*a* to 12*c* for the colors are configured to move between a position causing the intermediate transfer belt 11 to be in contact with the photosensitive drums 7*a* to 7*c*, and a position causing the intermediate transfer belt 11 to be separated from the photosensitive drums 7*a* to 7*c*.

Here, the transfer device 5 is assumed to be so-called an offset type transfer device. To be more precise, at the position causing the photosensitive drums 7*a* to 7*d* to be in contact with the intermediate transfer belt 11, the center distance between the center axis 01 of each of the photosensitive drums 7*a* to 7*d*, and of the center axis 02 of a corresponding one of the primary transfer rollers 12*a* to 12*d* is set to be larger than a sum of a radius R1 of each of the photosensitive drums 7*a* to 7*d* and a radius R2 of each of the primary transfer rollers 12*a* to 12*c*.

Figure 3:
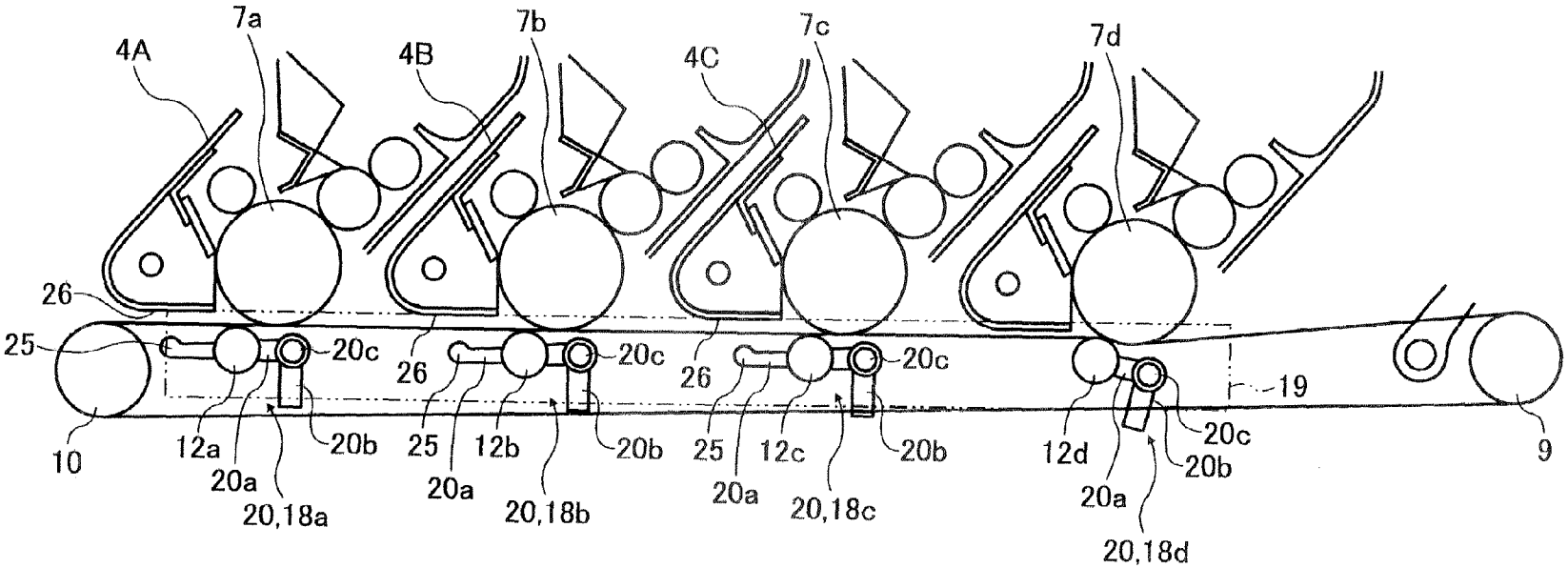
FIG. 3 is another explanatory diagram which shows the part of the intermediate transfer belt of the transfer device according to the present invention in an enlarged manner, and especially which shows a state where the intermediate transfer belt is separated from the photosensitive drums except the photosensitive drum for a black color.
Figure 6:
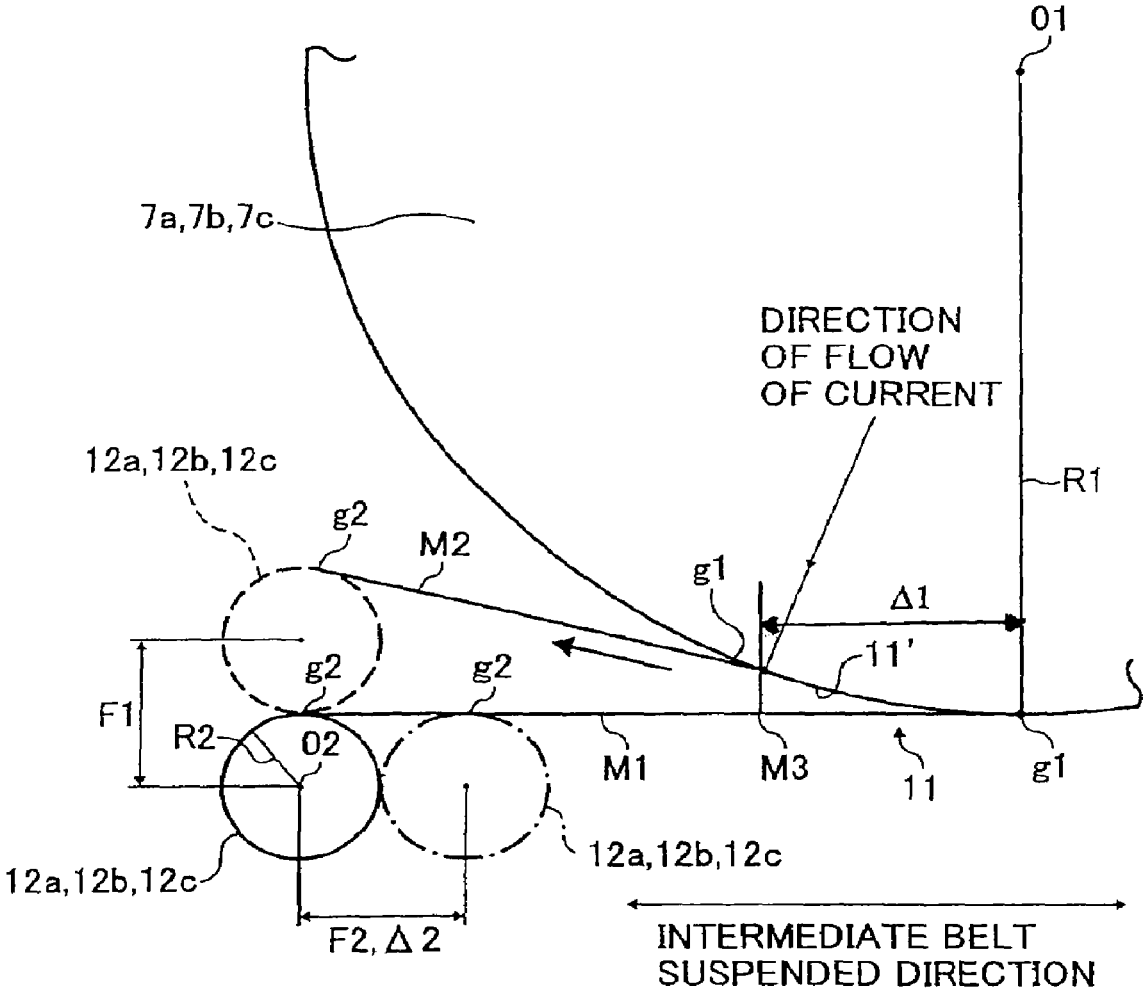
FIG. 6 is a partially enlarged diagram for explaining effects of the present invention.

When the slide plate 21 is moved against the biasing force of a bias spring 24 in the direction of an arrow A1 as shown in FIG. 6, the movable arm members 20 (18*a* to 18*c*) for yellow, cyan and magenta colors are rotated in the direction of an arrow B1 about the rotation axes 20*c*. Thereby, the primary transfer rollers 12*a* to 12*c* are also moved in an arc from the position causing the intermediate transfer belt 11 to be in contact with the photosensitive drums 7*a* to 7*d* as shown in FIG. 2 to the position causing the intermediate transfer belt 11 to be separated from the photosensitive drums 7*a* to 7*d*. On the other hand, when the slide plate 21 is moved in the direction of an arrow A2 as shown in FIG. 5, the movable arm members 20 (18*a* to 18*c*) for yellow, cyan and magenta colors are rotated in the direction of an arrow B2 about the rotation axis 20*c* by the biasing force of the bias spring 24. Accordingly, the primary transfer rollers 12*a* to 12*c* are moved in an arc from the position causing the intermediate transfer belt 11 to be separated from the photosensitive drums 7*a* to 7*c* as shown in FIG. 3 to the position causing the intermediate transfer belt 11 to be in contact with the photosensitive drums 7*a* to 7*c* as shown in FIG. 2.

An abutting portion 25 is provided to each of the support arms 20*a* of the movable arm members 20 (18*a* to 18*c*) for yellow, cyan and magenta colors. Each of the abutting portions 25 regulates the position of a corresponding one of the primary transfer rollers 12*a* to 12*c*

Here, the lower portions of the photosensitive drum cases 4 function as abutted members 4A to 4C on each of which the abutting portion 25 abuts. The positional relationships between the abutted members 4A to 4C and the photosensitive drums 7*a* to 7*c* are defined such that the positions of the abutted members causes the intermediate transfer belt 11 to be in contact with the photosensitive drums 7*a* to 7*c*. Each of the abutted members 4A to 4C includes an abutted surface 26 on which the abutting portion 25 abuts at the position causing the intermediate transfer belt 11 to be in contact with the photosensitive drums 7*a* to 7*c*.

The abutted surface 26 is formed of a flat surface parallel with the intermediate transfer belt 11 suspended directions. The abutting portion 25 has a circular arc shape as shown in an enlarged manner in FIG. 5. Each of the primary transfer rollers 12*a* to 12*c* is located between the abutting portion 25 and the rotation axis 20*c*. Then, at the position where the primary transfer rollers 12*a* to 12*c* cause the intermediate transfer belt 11 to be in contact with the photosensitive drums 7*a* to 7*c*, the abutting portions 25 are positioned to protrude upwardly from the intermediate transfer belt 11 being in contact with the photosensitive drums 7*a* to 7*c*.

Each of the abutted members 4A to 4C has a role to regulate one of positional errors of a corresponding one of the primary transfer rollers 12*a* to 12*c*. Specifically, the abutted members 4A to 4C regulate the positional error in the direction in which the abutting portion 25 abuts on the abutted surface 26, and which is perpendicular to the intermediate transfer belt 11 suspended directions.

It should be noted that, here, the primary transfer roller 12*d* is rotatably held at a position where the primary transfer roller 12*d* is in contact with the photosensitive drum 7*d* while sandwiching the intermediate transfer belt 11 therebetween. The primary transfer roller 12*d* is used at the time of a monochrome printing operation performed by use of only a black color.

Employing such a configuration suppresses the variation in a non-contacting distance of the intermediate transfer belt 11 due to the reciprocating positional change of each of the primary transfer rollers 12*a* to 12*c*. As a consequence, the variation in toner transfer efficiency can be suppressed.

FIG. 6 is a schematic diagram for explaining the variation in a non-contacting distance of the intermediate transfer belt 11 due to the reciprocating positional change of each of the primary transfer rollers 12*a* to 12*c*.

Specifically, as shown in FIG. 6, consider a case where the position of each of the primary transfer rollers 12*a* to 12*c* varies in the up and down directions (the directions are perpendicular to the intermediate transfer belt 11 suspended directions) within a range F1 due to the reciprocating positional change of each of the primary transfer rollers 12*a* to 12*c*. In this case, the non-contacting distance of the intermediate transfer belt 11 varies within a variation range from M1 to M2. Here, the non-contacting distance of the intermediate transfer belt 11 denotes the distance between a contacting portion g1 and a contacting portion g2 of the intermediate transfer belt 11. At the contacting portion g1, the intermediate transfer belt 11 is in contact with each of the photosensitive drums 7*a* to 7*c*, and at the contacting portion g2, the intermediate transfer belt 11 is in contact with each of the primary transfer rollers 12*a* to 12*c*.

On the other hand, consider a case where the position of each of the primary transfer rollers 12*a* to 12*c* varies in the right and left directions (the intermediate transfer belt 11 suspended direction) within a range F2 due to the reciprocating positional change of each of the primary transfer rollers 12*a* to 12*c*. In this case, the non-contacting distance of the intermediate transfer belt 11 varies within a variation range from M1 to M3. Here, similarly, the non-contacting distance of the intermediate transfer belt 11 denotes the distance between the contacting portion g1 at which the intermediate transfer belt 11 is in contact with each of the photosensitive drums 7*a* to 7*c*, and the contacting portion g2 at which the intermediate transfer belt 11 is in contact with each of the primary transfer rollers 12*a* to 12*c*.

In FIG. 6, the primary transfer roller 12*a* (12*b* and 12*c*) indicated by a solid line shows the reference position of the variation ranges F1 and F2. The primary transfer roller 12*a* (12*b* and 12*c*) indicated by a broken line shows the state being at the upper limit position of the variation range F1 and also at the reference position of the variation range F2. The primary transfer roller 12*a* (12*b* and 12*c*) indicated by an alternate long and short dash line shows the state being at the reference position of the variation line F1 and also at the rightmost position of the variation range F2.

Furthermore, the non-contacting distance M1 means the length of a non-contacting portion between the contacting portion g1 at which the intermediate transfer belt 11 is in contact with each of the photosensitive drums 7*a* to 7*c*, and the contacting portion g2 at which the intermediate transfer belt 11 is in contact with each of the primary transfer rollers 12*a* to 12*c*, when each of the primary transfer rollers 12*a* to 12*c* are at the reference position. The non-contacting distance M2 means the length of a non-contacting portion between the contacting portion g1 at which the intermediate transfer belt 11 is in contact with each of the photosensitive drums 7*a* to 7*c*, and the contacting portion g2 at which the intermediate transfer belt 11 is in contact with each of the primary transfer rollers 12*a* to 12*c*, when each of the primary transfer rollers 12*a* to 12*c* is at the uppermost position of the variation range F1 and also at the reference position of the variation range F2. The non-contacting distance M3 means the length of a non-contacting distance between the contacting portion g1 at which the intermediate transfer belt 11 is in contact with each of the photosensitive drums 7*a* to 7*c*, and the contacting portion g2 at which the intermediate transfer belt 11 is in contact with each of the primary transfer rollers 12*a* to 12*c*, when each of the primary transfer rollers 12*a* to 12*c* is at the reference position of the variation range F1 and also at the rightmost position of the variation range F2.

The variation Δ1 (Δ1=M1−M2) in the up and down directions of the non-contacting distance of the intermediate transfer belt 11 is greater than the variation Δ2 (Δ2=M3−M1) in the right and left directions of the contacting distance of the intermediate transfer belt 11. This is because, as shown in FIG. 6, when the positional errors of the primary transfer rollers 12*a* to 12*c* occur in the up and down directions, the intermediate transfer belt 11 is wound around the outer circumferential surfaces of the photosensitive drums 7*a* to 7*c*. Reference numeral 11' is given to the wound portion of the intermediate transfer belt 11.

A predetermined electrical potential is previously applied to each of the photosensitive drums 7*a* to 7*c*, and a toner is attached thereto in accordance with exposure light. Then, an electrical potential difference V occurs between each of the photosensitive drums 7*a* to 7*c* and a corresponding one of the primary transfer rollers 12*a* to 12*c*. Here, when there is a change in the length of the non-contacting portion between the contacting portion g1 at which the intermediate transfer belt 11 is in contact with the photosensitive drums 7*a* to 7*c*, and the contacting portion g2 at which the intermediate transfer belt 11 is in contact with the primary transfer rollers 12*a* to 12*c*, the amount of resistance corresponding to the length of the intermediate transfer belt 11 varies in accordance with the length of the non-contacting portion. This causes the electrical potential difference V to vary, thereby resulting in a change in transfer efficiency to the intermediate transfer belt 11.

In this situation, the variation in the non-contacting distance of the intermediate transfer belt 11 can be suppressed by regulating the positional error of each of the primary transfer rollers 12*a* to 12*c* in the up and down directions (the directions perpendicular to the intermediate transfer belt 11 suspended directions), the positional error occurring due to the reciprocating positional change of each of the primary transfer rollers 12*a* to 12*c*.

MODIFIED EXAMPLE 1

Figure 7:
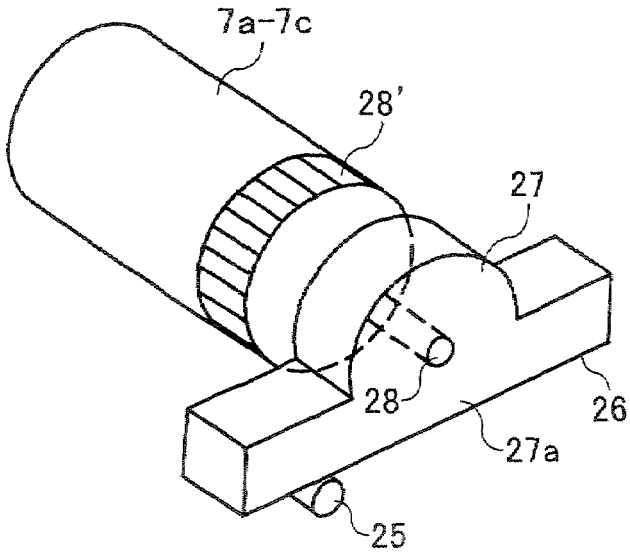
FIG. 7 is an explanatory diagram showing a modified example of the present invention, and especially showing a state where the abutted surface is formed at the bottom portion of a bearing member.

Although the lower portions of the photosensitive drum cases 4 are employed as the abutted members 4A to 4C in the foregoing embodiment, lower portions 27*a* of shaft bearing members 27 of the photosensitive drums 7*a* to 7*c* may be used as shown in FIG. 7. It should be noted that, in FIG. 7, reference numeral 28 denotes a center shaft of each of the photosensitive drums 7*a* to 7*c*, and a reference numeral 28' denotes a gear. Here, each of the photosensitive drums 7*a* to 7*c* rotates around the center shaft 28.

MODIFIED EXAMPLE 2

Figure 8:
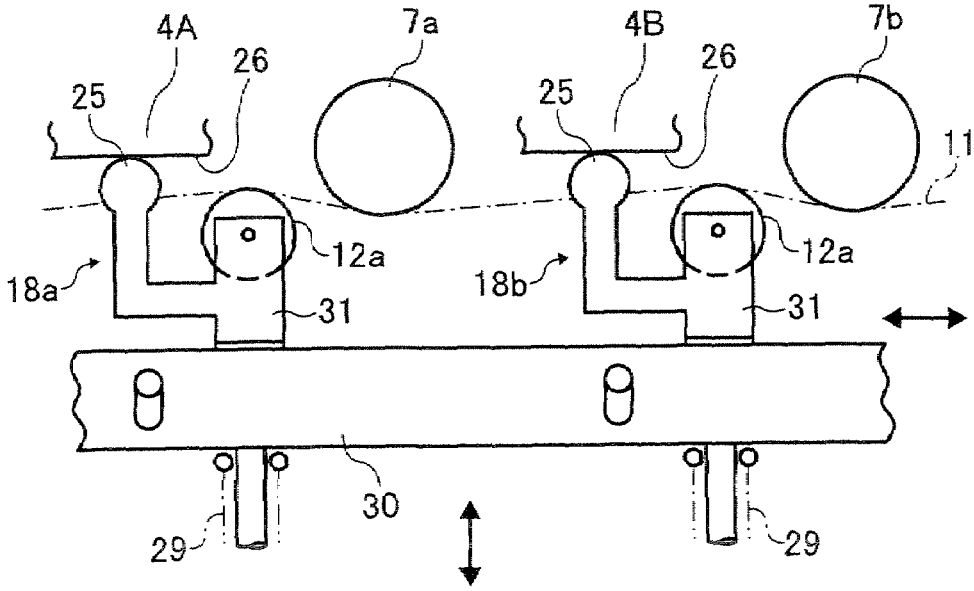
FIG. 8 is an explanatory diagram showing another modified example of the present invention, and especially showing a state in which primary transfer rollers are vertically driven in up and down directions.

Here, as shown in FIG. 8, the movable members 18*a* to 18*c* are provided with an up and down directional plate 30 biased upwardly by springs 29. Shaft bearing plates 31 integrally including the respective abutting portions 25 are provided to the up and down directional plate 30. The primary transfer rollers 12*a* to 12*c* are rotatably supported by the shaft bearing plates 31, respectively.

In Modified Example 2, the position causing the intermediate transfer belt 11 to be in contact with the photosensitive drums 7*a* to 7*c*, and the position causing the intermediate transfer belt 11 to be separated from the photosensitive drums 7*a* to 7*c* exist in a direction perpendicular (vertical direction) to the intermediate transfer belt 11 suspended directions. Accordingly, when the up and down directional plate 30 is lowered, the position of the primary transfer rollers 12*a* to 12*c* is changed from the position causing the intermediate transfer belt 11 to be in contact with the photosensitive drums 7*a* to 7*c*, to the position causing the intermediate transfer belt 11 to be separated from the photosensitive drums 7*a* to 7*c*.

On the other hand, when the up and down directional plate 30 is moved upward, the position of the primary transfer rollers 12*a* to 12*c* is changed from the position causing the intermediate transfer belt 11 to be separated from the photosensitive drums 7*a* to 7*c*, to the position causing the intermediate transfer belt 11 to be in contact with the photosensitive drums 7*a* to 7*c*.

Although the preferred embodiments of the present invention have been mentioned, it should be noted that the present invention is not limited to these embodiments, various modifications and changes can be made to these embodiments.

What is claimed is:

1. A transfer device, comprising:

an intermediate transfer belt provided to extend in an arranged direction of a plurality of photosensitive drums;

primary transfer rollers each configured to transfer a toner image formed on a corresponding one of the plurality of photosensitive drums to the intermediate transfer belt and being rotatably supported by a movable member including an abutting portion which regulates a position of the primary transfer roller, wherein each of the primary transfer rollers is configured to be moved between a first position causing the intermediate transfer belt to be in contact with the photosensitive drums and a second position causing the intermediate transfer belt to be separated from the photosensitive drums;

a plate connected to the movable member via a spring, wherein the plate is configured to move in a direction substantially parallel to a suspension direction of the intermediate transfer belt to move the spring to rotate the movable member around a first axis; and an abutted member positioned above the movable member and including an abutted surface on which the abutting portion is abutted in the first position and which is configured to regulate a positional deviation of the primary transfer rollers in a direction perpendicular to the suspension direction of the intermediate transfer belt, wherein a center distance between a center axis of each one of the photosensitive drums and a center axis of a corresponding one of the primary transfer rollers at the first position is set to be larger than a sum of radiuses of the each one of the photosensitive drums and the corresponding one of the primary transfer rollers.

2. The transfer device according to claim 1, wherein the abutted surface is a flat surface parallel with the suspension direction of the intermediate transfer belt.

3. The transfer device according to claim 2, wherein the abutted member is formed by a portion of a case which houses the photosensitive drums.

4. The transfer device according to claim 2, wherein the abutted member is formed by a portion of a shaft bearing member for the photosensitive drums.

5. The transfer device according to claim 2, wherein, the first position and the second position exist in a direction perpendicular to the suspension direction of the intermediate transfer belt, and the movable member is configured to cause the primary transfer roller to reciprocate between the first position and the second position.

6. The transfer device according to claim 5, wherein the abutting portion has a circular arc shape.

7. The transfer device according to claim 6, wherein, the movable member comprises an arm which is rotated about a rotation shaft, and the primary transfer roller is located between the abutting portion and the rotation shaft.

8. The transfer device according to claim 2, wherein the movable member is configured to cause the primary transfer roller to reciprocate in an arc between the first position and the second position.

9. The transfer device according to claim 8, wherein the abutting portion has a circular arc shape.

10. The transfer device according to claim 9, wherein, the intermediate transfer belt is located below the photosensitive drums, and the abutting portion is positioned to protrude upwardly from the intermediate transfer belt at the first position.

11. The transfer device according to claim 8, wherein, the movable member comprises an arm which is rotated about a rotation shaft, and the primary transfer roller is located between the abutting portion and the rotation shaft.

12. An image forming apparatus comprising the transfer device as recited in claim 1.

13. A transfer device, comprising:

a photosensitive unit including a casing and at least one photosensitive drum positioned in the casing;

an intermediate transfer belt configured to receive a transfer image from the at least one photosensitive drum;

at least one primary transfer roller configured to transfer the toner image from the at least one photosensitive drum to the intermediate transfer belt;

a movable member configured to rotatably support the at least one primary transfer roller, and including an abutting portion which regulates a position of the at least one primary transfer roller by abutting against the photosensitive unit to cause the intermediate transfer belt to be in contact with the at least one photosensitive drum; and a plate connected to the movable member via a spring, wherein the plate is configured to move in a direction substantially parallel to a suspension direction of the intermediate transfer belt to move the spring to rotate the movable member around a first axis.

14. The transfer device according to claim 13, wherein, when the abutting portion is separated from the photosensitive unit, the intermediate transfer belt is separated from the at least one photosensitive drum.

15. The transfer device according to claim 13, wherein the abutting portion abuts against the casing to cause the intermediate transfer belt to be in contact with the at least one photosensitive drum.

16. The transfer device according to claim 13, wherein, the intermediate transfer belt is located below the at least one photosensitive drum, and the abutting portion is positioned to protrude upwardly from the intermediate transfer belt to abut against the photosensitive unit.

17. A transfer device, comprising:

a photosensitive unit including a casing and at least one photosensitive drum positioned in the casing;

an intermediate transfer belt configured to receive a transfer image from the at least one photosensitive drum;

at least one primary transfer roller configured to transfer the toner image from the at least one photosensitive drum to the intermediate transfer belt; and a movable member configured to rotatably support the at least one primary transfer roller, and including an abutting portion which regulates a position of the at least one primary transfer roller by abutting against the photosensitive unit to cause the intermediate transfer belt to be in contact with the at least one photosensitive drum, wherein the photosensitive unit includes a shaft on which the at least one photosensitive drum is positioned and a shaft support unit configured to support the shaft, and the abutting portion abuts against the shaft support unit to cause the intermediate transfer belt to be in contact with the at least one photosensitive drum.

18. The transfer device according to claim 17, wherein the abutting portion of the movable member is configured to be positioned on a same side of the intermediate transfer belt as the at least one photosensitive drum when the intermediate transfer belt is in contact with the photosensitive drum.

19. The transfer device according to claim 17, wherein the abutting portion and the shaft support unit each include a contacting portion, and one of the contacting portions has a flat surface and another one of the contacting portions has a circular arc shape.

20. An image forming apparatus, comprising:

a photosensitive unit including a casing and at least one photosensitive drum positioned in the casing;

an intermediate transfer belt configured to receive a transfer image from the at least one photosensitive drum;

at least one primary transfer roller configured to transfer the toner image from the at least one photosensitive drum to the intermediate transfer belt; and a movable member configured to rotatably support the at least one primary transfer roller, and including an abutting portion which regulates a position of the at least one primary transfer roller by abutting against the photosensitive unit to cause the intermediate transfer belt to be in contact with the at least one photosensitive drum, wherein the photosensitive unit includes a shaft on which the at least one photosensitive drum is positioned and a shaft support unit configured to support the shaft, and the abutting portion abuts the shaft support unit to cause the intermediate transfer belt to be in contact with the at least one photosensitive drum.

21. The image forming apparatus according to claim 20, wherein the abutting portion of the movable member is configured to to be positioned on a same side of the intermediate transfer belt as the at least one photosensitive drum when the intermediate transfer belt is in contact with the photosensitive drum.

22. The image forming apparatus according to claim 20, wherein the abutting portion and the shaft support unit each include a contacting portion, and one of the contacting portions has a flat surface and another one of the contacting portions has a circular arc shape.

23. An imaging forming apparatus, comprising:

at least one photosensitive drum;

an intermediate transfer belt configured to receive a toner image from the at least one photosensitive drum;

at least one primary transfer roller configured to transfer the toner image from the at least one photosensitive drum to the intermediate transfer belt and to be moved between a position causing the intermediate transfer belt to be in contact with the at least one photosensitive drum and a position causing the intermediate transfer belt to be separated from the at least one photosensitive drum; and a movable member configured to rotatably support the at least one primary transfer roller, the movable member including a part disposed at a position on a same side of the intermediate transfer belt as the at least one photosensitive drum when the primary transfer roller is in the position causing the intermediate transfer belt to be in contact with the photosensitive drum.

24. The image forming apparatus according to claim 23, wherein the part comprises an abutting portion provided on the movable member, the part being contactable with an abutted portion.

25. The image forming apparatus according to claim 24, further comprising:

a casing containing the photosensitive drum, wherein the abutting portion is in contact with the casing to regulate the position of the primary transfer roller at the position where the primary transfer roller causes the intermediate transfer belt to be in contact with the photosensitive drum.

26. The image forming apparatus according to claim 25, wherein the abutting portion and the casing each include a contacting portion, and one of the contacting portions has a flat surface and another one of the contacting portions has a circular arc shape.

27. The image forming apparatus according to claim 24, further comprising:

a photosensitive unit including the photosensitive drum, a shaft on which the photosensitive drum is positioned, and a shaft support unit configured to support the shaft, wherein the abutting portion is in contact with the shaft support unit to regulate the position of the primary transfer roller at the position where the primary transfer roller causes the intermediate transfer belt to be in contact with the photosensitive drum.

28. The image forming apparatus according to claim 27, wherein the abutting portion and the shaft support unit each include a contacting portion, and one of the contacting portions has a flat surface and another one of the contacting portions has a circular arc shape.

* * * * *